US010667059B1

(12) United States Patent
Fu

(10) Patent No.: US 10,667,059 B1
(45) Date of Patent: May 26, 2020

(54) DRIVER STRUCTURE OF THIN SPEAKER

(71) Applicant: MEILOON INDUSTRIAL CO., LTD., Tao Yuan (TW)

(72) Inventor: Po-Hsiang Fu, Kaohsiung (TW)

(73) Assignee: Meiloon Industrial Co., Ltd., Taoyuan (TW)

( * ) Notice: Subject to any disclaimer, the term of this patent is extended or adjusted under 35 U.S.C. 154(b) by 0 days.

(21) Appl. No.: 16/404,887

(22) Filed: May 7, 2019

(51) Int. Cl.

| | |
|---|---|
| ***H04R 25/00*** | (2006.01) |
| ***H04R 9/04*** | (2006.01) |
| ***H04R 7/02*** | (2006.01) |
| ***H04R 7/18*** | (2006.01) |
| ***H04R 9/02*** | (2006.01) |

(52) U.S. Cl.
CPC ..... *H04R 9/046* (2013.01); *H04R 7/02* (2013.01); *H04R 7/18* (2013.01); *H04R 9/025* (2013.01)

(58) Field of Classification Search
CPC . H04R 9/046; H04R 7/02; H04R 7/18; H04R 9/025
USPC ..... 381/400
See application file for complete search history.

(56) References Cited

U.S. PATENT DOCUMENTS

| | | | | |
|---|---|---|---|---|
| 5,757,945 | A * | 5/1998 | Sakamoto | H04R 9/06 381/400 |
| 6,865,282 | B2 * | 3/2005 | Weisman | H04R 9/043 381/404 |
| 8,731,230 | B2 * | 5/2014 | Peng | H04R 9/045 381/403 |
| 9,008,348 | B1 * | 4/2015 | Kallen | H04R 15/00 381/404 |
| 9,743,163 | B2 * | 8/2017 | Ito | H04R 1/00 |
| 9,832,557 | B2 * | 11/2017 | Park | H04R 1/06 |
| 2006/0274914 | A1 * | 12/2006 | Horigome | H04R 1/22 381/424 |
| 2007/0223775 | A1 * | 9/2007 | Sugiura | H04R 9/046 381/407 |
| 2019/0281374 | A1 * | 9/2019 | Proni | H04R 1/028 |

* cited by examiner

*Primary Examiner* — Phylesha Dabney
(74) *Attorney, Agent, or Firm* — Demian K. Jackson; Jackson IPG PLLC

(57) ABSTRACT

A driver structure of a thin speaker contains: a voice coil, a suspension mechanism, at least two wires, a holder, and a magnetic circuit element. The suspension mechanism includes a fixer, a diaphragm, and a spider. The diaphragm is connected with a top of an outer periphery of the fixer, the voice coil is connected with an inner periphery of the diaphragm, the spider is connected with a bottom of an inner periphery of the fixer, and a top of an inner periphery of the spider is in connection with a lower surface of the diaphragm. The at least two wires are connected with the spider and the voice coil. The holder is connected with the fixer and includes a terminal set coupled with the at least two wires. The magnetic circuit element is fixed on the holder, and the voice coil is fitted with the magnetic circuit element.

6 Claims, 3 Drawing Sheets

DRIVER STRUCTURE OF THIN SPEAKER

TECHNICAL FIELD

The present disclosure relates to a driver structure of a thin speaker which is connected easily and has thin thickness and high sensitivity.

BACKGROUND

A conventional driver structure of a speaker is comprised of a plastic fixer, a voice coil, a paper diaphragm, a spider, a terminal set, and a magnetic circuit element.

However, the plastic fixer increases a weight of a suspension system to cause a thick thickness, poor sensitivity, and voice distortion.

SUMMARY

A primary aspect of the present invention is to provide a driver structure of a thin speaker which is connected easily and has thin thickness and high sensitivity.

Other objects and features will be in part apparent and in part pointed out hereinafter.

To obtain above-mentioned aspects, a driver structure of a thin speaker provided by the present invention contains: a voice coil, a suspension mechanism, at least two wires, a holder, and a magnetic circuit element.

The suspension mechanism includes a fixer, a diaphragm, and a spider. A bottom of an outer periphery of the diaphragm is connected with a top of an outer periphery of the fixer, an outer periphery of a first end of the voice coil is connected with an inner periphery of the diaphragm, a top of an outer periphery of the spider is connected with a bottom of an inner periphery of the fixer, and a top of an inner periphery of the spider is in connection with a lower surface of the diaphragm.

The at least two wires is connected with a lower surface of the spider and the voice coil.

The holder is connected with a bottom of the outer periphery of the fixer, and the holder includes a terminal set coupled with the at least two wires.

The magnetic circuit element is fixed on a bottom of a center of the holder, and the voice coil is fitted with the magnetic circuit element.

Preferably, the voice coil includes a dust-proof cover covered on a top of a second end thereof.

Preferably, the fixer is made of metal or non-metallic material.

Preferably, the diaphragm is made of aluminum.

Preferably, the diaphragm has a V-shaped cross section.

Preferably, the holder is made metal or non-metallic material.

BRIEF DESCRIPTION OF THE DRAWINGS

Corresponding reference characters indicate corresponding parts throughout the drawings.

DETAILED DESCRIPTION

Figure 1:
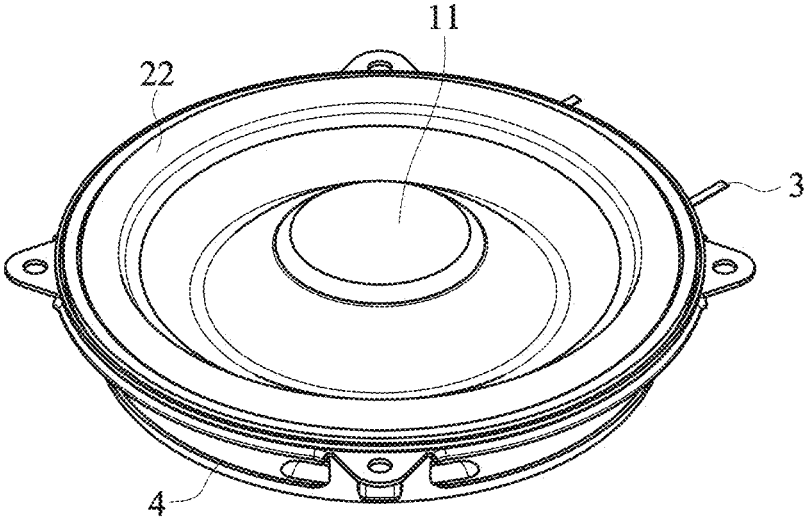
FIG. 1 is a perspective view showing the assembly of a driver structure of a thin speaker according to a preferred embodiment of the present invention.
Figure 2:
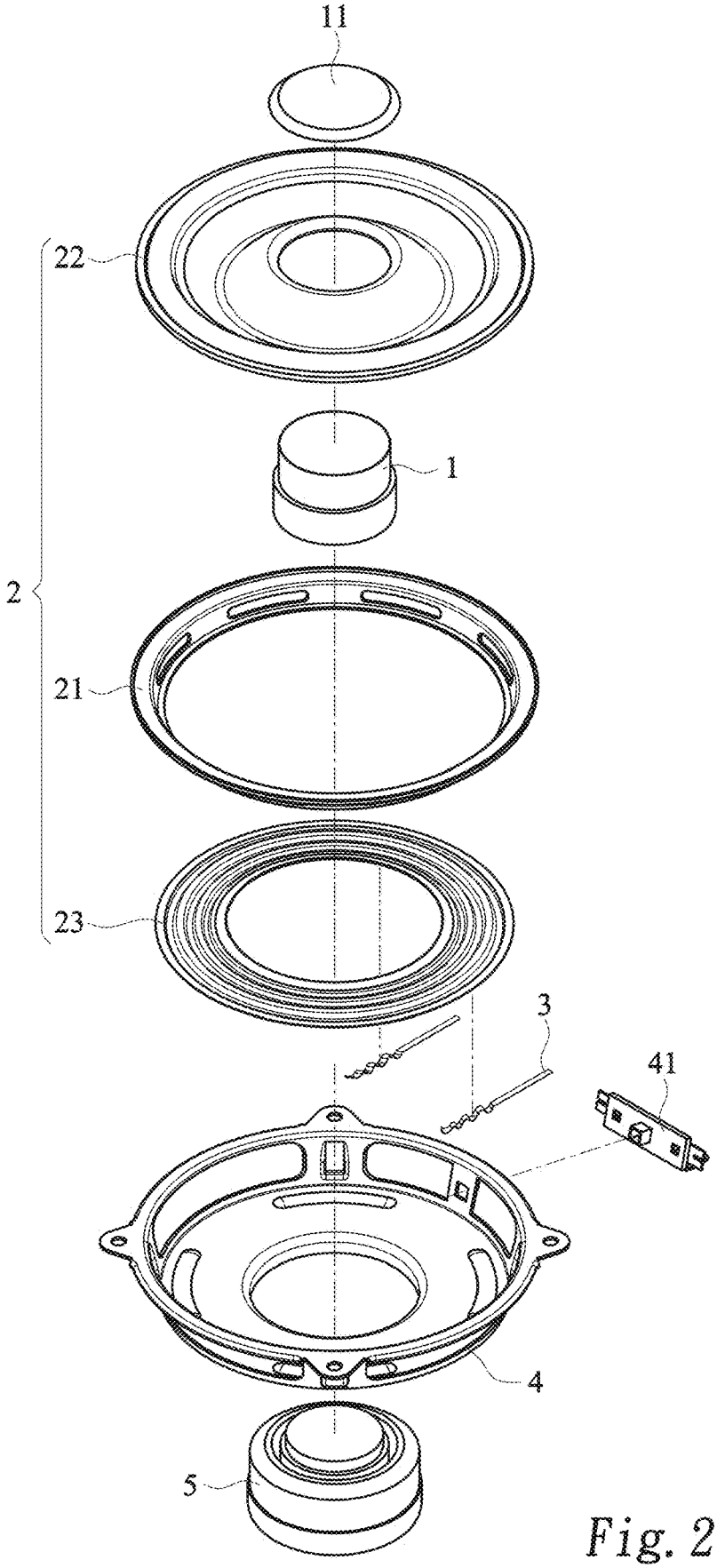
FIG. 2 is a perspective view showing the exploded components of the driver structure of the thin speaker according to the preferred embodiment of the present invention.
Figure 3:
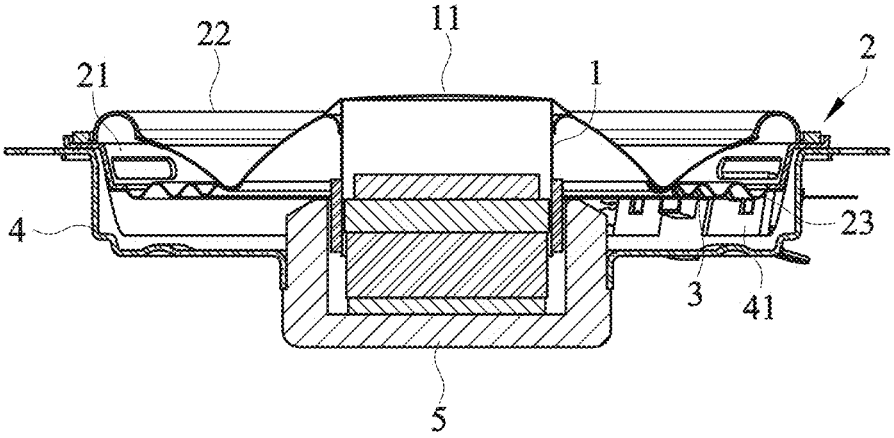
FIG. 3 is a cross sectional view showing the assembly of the driver structure of the thin speaker according to the preferred embodiment of the present invention.

With reference to FIGS. 1-3, a driver structure of a thin speaker according to a preferred embodiment of the present invention comprises: a voice coil 1, a suspension mechanism 2, at least two wires 3, a holder 4, and a magnetic circuit element 5.

The suspension mechanism 2 includes a fixer 21, a diaphragm 22, and a spider 23, wherein a bottom of an outer periphery of the diaphragm 22 is connected with a top of an outer periphery of the fixer 21, an outer periphery of a first end of the voice coil 1 is connected with an inner periphery of the diaphragm 22, a top of an outer periphery of the spider 23 is connected with a bottom of an inner periphery of the fixer 21, and a top of an inner periphery of the spider 23 is in connection with a lower surface of the diaphragm 22.

The at least two wires 3 are connected with a lower surface of the spider 23 and the voice coil 1.

The holder 4 is connected with a bottom of the outer periphery of the fixer 21, and the holder 4 includes a terminal set 41 coupled with the at least two wires 3.

The magnetic circuit element 5 is fixed on a bottom of a center of the holder 4, and the voice coil 1 is fitted with the magnetic circuit element 5.

In assembly, the bottom of the outer periphery of the diaphragm 22 is connected with the top of the outer periphery of the fixer 21, the outer periphery of the end of the voice coil 1 is connected with the inner periphery of the diaphragm 22, the top of the outer periphery of the spider 23 is coupled with the bottom of the inner periphery of the fixer 21, and the top of the inner periphery of the spider 23 is in connection with the lower surface of the diaphragm 22. Thereafter, the voice coil 1 is connected with the at least two wires 3 and the suspension mechanism 2, the suspension mechanism 2 of the voice coil 1 is fixed with the holder 4 by ways of a bottom of the outer periphery of the fixer 21, the voice coil 1 is fitted with the magnetic circuit element 5, and the at least two wires 3 are coupled with the terminal set 41 of the holder 4, thus connecting the driver structure of the thin speaker. Accordingly, the spider 23 contacts with the fixer 21 and the diaphragm 22 matingly, and the at least two wires 3 are mounted easily.

In addition, a stroke from the spider 23 to the holder 4 and a stroke from the diaphragm 22 to the magnetic circuit element 5 are controlled exactly by using the suspension mechanism 2 and the holder 4 so as to reduce a thickness of the driver structure of the thin speaker and to enhance a sensitivity of the driver structure.

The voice coil 1 includes a dust-proof cover 11 covered on a top of a second end thereof so as to avoid an object dropping into the voice coil 1.

The fixer 21 is made of metal or non-metallic material.

The diaphragm 22 is made of aluminum so as to reduce a weight of the suspension mechanism 2, and the diaphragm 22 has a V-shaped cross section so as to reduce vibration of the diaphragm 22, and an operation direction of the voice coil 1 does not offset, thus sending sounds brilliantly.

When the diaphragm 22 has the V-shaped cross section, the spider 23 is connected with the fixer 21 and the diaphragm 22 so as to reduce the weight of the suspension mechanism 2 and to enhance the sensitivity of the driver structure.

The holder 4 is made any one of metal, non-metallic material and other materials.

Thereby, the driver structure of the thin speaker is connected easily and has thin thickness and high sensitivity.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A driver structure of a thin speaker comprising:

a voice coil;

a suspension mechanism including a fixer, a diaphragm, and a spider, wherein a bottom of an outer periphery of the diaphragm is connected with a top of an outer periphery of the fixer, an outer periphery of a first end of the voice coil is connected with an inner periphery of the diaphragm, a top of an outer periphery of the spider is connected with a bottom of an inner periphery of the fixer, and a top of an inner periphery of the spider is in connection with a lower surface of the diaphragm;

at least two wires connected with a lower surface of the spider and the voice coil;

a holder connected with a bottom of the outer periphery of the fixer, and the holder including a terminal set coupled with the at least two wires; and a magnetic circuit element fixed on a bottom of a center of the holder, wherein the voice coil is fitted with the magnetic circuit element.

2. The driver structure of the thin speaker as claimed in claim 1, wherein the voice coil includes a dust-proof cover covered on a top of a second end thereof.

3. The driver structure of the thin speaker as claimed in claim 1, wherein the fixer is made of metal or non-metallic material.

4. The driver structure of the thin speaker as claimed in claim 1, wherein the diaphragm is made of aluminum.

5. The driver structure of the thin speaker as claimed in claim 1, wherein the diaphragm has a V-shaped cross section.

6. The driver structure of the thin speaker as claimed in claim 1, wherein the holder is made metal or non-metallic material.

* * * * *